US006309311B1

(12) United States Patent
Lu

(10) Patent No.: US 6,309,311 B1
(45) Date of Patent: Oct. 30, 2001

(54) GOLF CLUB HEAD WITH WEIGHTED FORCE ABSORBING ATTACHMENT

(76) Inventor: Clive S. Lu, 282 Newbridge Rd., Hicksville, NY (US) 11801

( * ) Notice: Subject to any disclaimer, the term of this patent is extended or adjusted under 35 U.S.C. 154(b) by 0 days.

(21) Appl. No.: 09/493,010

(22) Filed: Jan. 28, 2000

(51) Int. Cl.[7] ..... A63B 53/04

(52) U.S. Cl. ..... 473/332; 473/346; 473/350; 473/349; 473/340

(58) Field of Search ..... 473/251, 256, 473/324, 313, 329, 332, 340, 341, 342, 345, 349, 350, 346, 290, 291, 282

(56) References Cited

U.S. PATENT DOCUMENTS

| | | | |
|---|---|---|---|
| D. 234,962 | * | 4/1975 | Swash . |
| D. 235,668 | * | 7/1975 | Swash . |
| 2,750,194 | | 6/1956 | Clark . |
| 3,220,733 | | 11/1965 | Saleeby . |
| 3,814,437 | * | 6/1974 | Wingquist . |
| 4,511,145 | | 4/1985 | Schmidt . |
| 4,826,172 | * | 5/1989 | Antonious . |
| 4,836,550 | * | 6/1989 | Kobayashi . |
| 5,000,454 | * | 3/1991 | Soda . |
| 5,014,993 | | 5/1991 | Antonious . |
| 5,048,835 | * | 9/1991 | Gorman . |
| 5,121,922 | | 6/1992 | Harsh, Sr. . |
| 5,295,689 | | 3/1994 | Lundberg . |
| 5,328,184 | * | 7/1994 | Antonious . |
| 5,447,307 | | 9/1995 | Antonious . |
| 5,632,694 | | 5/1997 | Lee . |
| 5,643,109 | | 7/1997 | Rose et al. . |
| 5,820,481 | | 10/1998 | Raudman . |
| 5,830,078 | * | 11/1998 | McMahan . |
| 6,015,354 | * | 1/2000 | Ahn . |
| 6,027,415 | * | 2/2000 | Takeda . |
| 6,077,173 | * | 6/2000 | Stites . |
| 6,080,070 | * | 6/2000 | Whitley . |

* cited by examiner

*Primary Examiner*—Sebastiano Passaniti
(74) *Attorney, Agent, or Firm*—Welsh & Flaxman LLC

(57) ABSTRACT

A golf club head having a force absorbing mass located behind the ball striking face and a force transmitting arcuate member connected between the mass and a rear surface of the club head. Impact forces are transmitted through the arcuate member into the force absorbing mass where they are dissipated.

5 Claims, 2 Drawing Sheets

GOLF CLUB HEAD WITH WEIGHTED FORCE ABSORBING ATTACHMENT

BACKGROUND OF THE INVENTION

1. Field of the Invention

The present invention relates to golf clubs. In particular, the present invention relates to golf club heads having a unique weighting and energy absorbing structure.

2. Description of the Prior Art

The materials and shapes employed in many golf club head designs often exhibit poor force and energy transmitting features which require a golfer to strike the ball precisely on the center of percussion to obtain maximum energy transfer to the golf ball. In an effort to overcome these disadvantages, a variety of shape and weight configurations have been developed in the prior patent art.

For example, U.S. Pat. No. 5,014,993 to Antonious shows an iron-type golf club head for a peripheral weighted cavity backed iron-type golf club head. The club head has an arcuate shaped secondary weight configuration designed to provide increased control and feel. This is achieved by attaching the secondary weight member at two points which intersect and are integrally connected with the peripheral weight.

U.S. Pat. No. 5,447,307 to Antonious shows an iron-type golf club head with an improved anchor-back hosel. The lower section of the hosel emanates from the back of the club head adjacent the rear of the club face. This lower section of the hosel may take a variety of shapes as disclosed by Antonious.

U.S. Pat. No. 5,295,689 to Lundberg shows a golf club head having an internal truss placed directly behind the ball striking face to absorb impact forces.

U.S. Pat. No. 4,511,145 to Schmidt shows a reinforced hollow metal wood. The metal wood includes an arcuate shaped ridge connected between the heel and toe portion of the interior of the club head shell.

U.S. Pat. No. 5,121,922 to Harsh shows a putter-type golf club head having a resiliently mounted weight member located behind the ball striking face.

U.S. Pat. No. 5,643,119 to Rose et al. shows a golf club putter head. The putter head is composed of a continuous tensioned band and an internal weighting system including a tensioning block, a screw connector and a forward rectangular mortise.

U.S. Pat. No. 5,820,481 to Rowdman shows a golf putter designed to dampen vibrations. The putter includes an anvil and a block of elastomeric material mounted directly behind the ball striking face.

As the prior art shows, many developments have been proposed for improving the striking characteristics of golf club heads. While some of these developments solve problems within the industry, a need still exists for an improved weighting and energy absorbing structure for golf club heads. The present invention provides such an energy absorbing structure for golf club heads.

SUMMARY OF THE INVENTION

The present invention relates to golf club heads, including wood, iron and putter type golf club heads, provided with a weighted block, or mass, located behind the ball striking face. The weight member is connected to the ball striking face by an arcuate, force transmitting and absorbing member.

In a preferred embodiment of the invention, a hollow golf club head, such as a metal wood or putter, is provided with a longitudinal weight member mounted rearwardly within the cavity of the club head along the back inner surface of the cavity. The arcuate member is coupled between the weight member and the back inner surface of the cavity. The arcuate member has ends connected to opposite ends of the weight member and has an apex located on, or directly behind, the ball striking face of the club head. The apex is preferably located at or near the center of percussion of the club head.

The arcuate member is arch shaped. The arcuate member is resilient and is capable of at least minor deflections when a golf ball is struck. In this way, the arcuate member transmits and absorbs energy from directly behind the ball striking face to the rear weight mounted within the club head. This arcuate member distributes the force and/or vibrational pressure evenly along the interior weight member, providing enhanced feel and energy transfer to a golf ball struck by the ball striking face of the club head.

The apex of the arcuate member is preferably connected to, or at least touches, the back inner surface of the striking face of the club head. The arcuate member may be made from a variety of different materials that dampen vibration from the ball striking face as the club contacts the ball. The force travels through the arcuate legs of the arcuate member to the weighted member behind the ball striking face. The transfer of energy in this way tends to cancel out, or dampen, undesirable forces which travel around the perimeter of the club head.

In preferred embodiments, a putter type club head is formed with a rear cavity for mounting the arcuate member and associated weight. Metal wood or iron type club heads in accordance with the present invention use a weight member close to the bottom of the club head, locating the center of gravity downwardly and away from the ball striking face.

Among the objects of the present invention are the provision of a golf club head having an improved weight distribution.

It is also an object of the present invention to provide a golf club head having an improved shock absorbing and energy transferring structure.

Another object of the present invention is the provision of a golf club head which creates greater feel when a golf ball impacts against the ball striking face of a club head.

Still another object is the provision of an improved golf club head wherein forces created by the impact of the golf ball are more evenly distributed to allow a greater percentage of the club head forces to be transferred to the ball.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
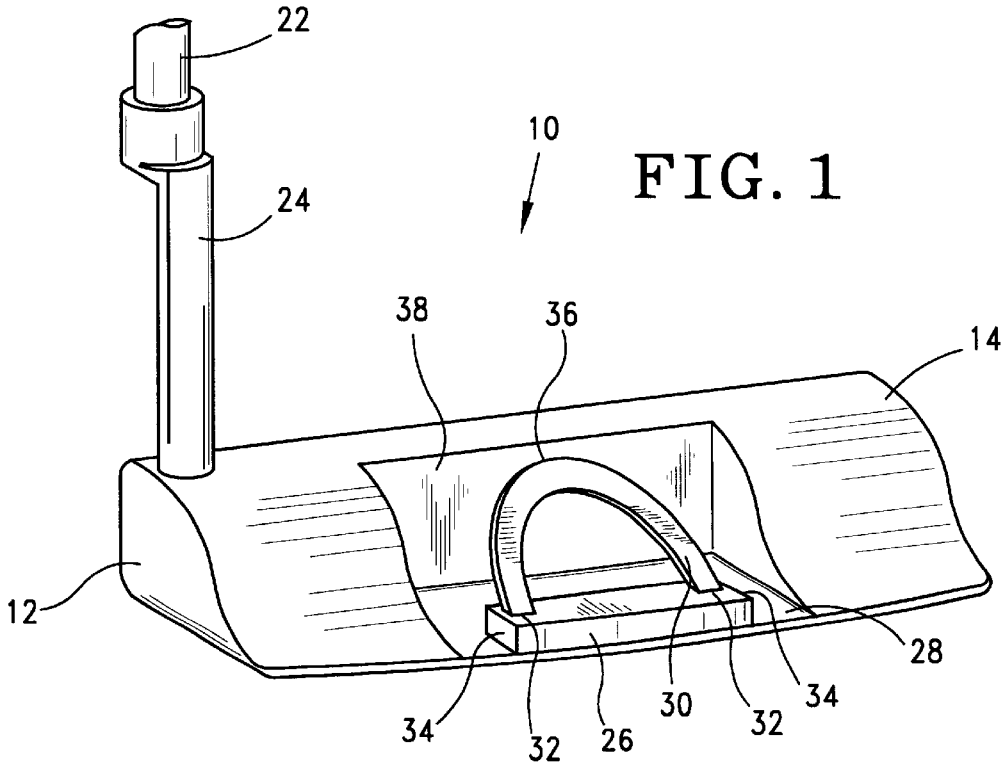
FIG. 1 is a rear perspective view of a first embodiment of a golf club head in accordance with present invention.
Figure 2:
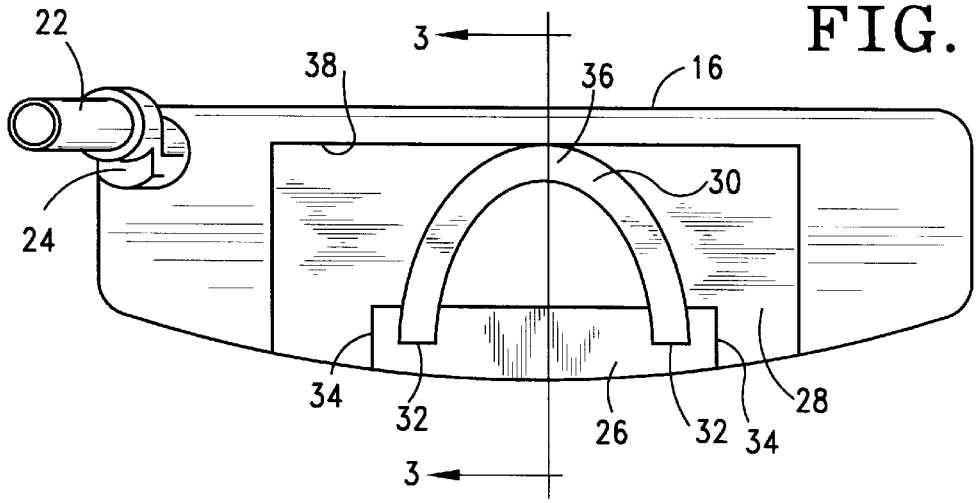
FIG. 2 is a top plan view of the club head of FIG. 1.
Figure 3:
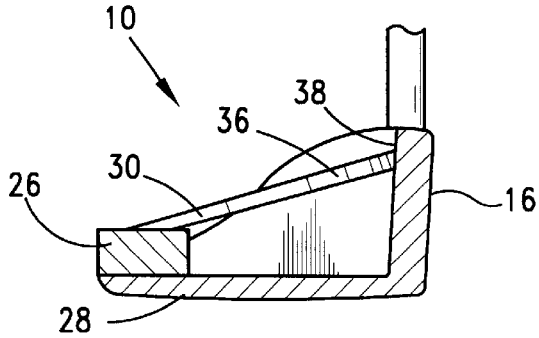
FIG. 3 is a cross sectional view taken along the line 3—3 of the club head of FIG. 2.

FIGS. 1–3 disclose a putter type golf club head 10 in accordance with the present invention. The putter head 10 includes a heel 12, a toe 14, a ball striking face 16, an upper surface 18 and a lower surface 20. A shaft 22 is connected to a hosel 24 at the heel 12 of the club head 10.

Controlled transfer of the energy generated upon the striking of a golf ball is achieved by the provision of a longitudinal force absorbing mass, or weight, 26 mounted along the rear flange 28 of the club head 10 and an acuate member 30 positioned between the force absorbing weight 26 and the inner wall surface 38 of the ball striking face 16.

The force absorbing weight 26 is preferably formed from a material which is denser than that of the club head 10 itself. For example, it is contemplated that the force absorbing weight 26 may be manufactured from copper or tungsten, and even steel where the remaining portions of the club head 10 are manufactured from aluminum or other lighter weight materials. In fact, it is preferred that the force absorbing weight 26 comprise at least 15% of the total weight of the club head 10. By adding a weighted member in this way, the force absorbing weight block 26 lowers the club head's center of gravity, while also absorbing forces in the manner discussed below. While specific materials are disclosed herein, those skilled in the art will appreciate the variety of materials which may be used within the spirit of the present invention.

The arcuate member 30 is arch shaped and is constructed to provide a resilient, shock absorbing effect in the body of the club head 10. The arcuate member 30 includes ends 32 connected to opposite ends 34 of the force absorbing weight 26 and an apex 36 which touches, or is connected to, the inner wall surface 38 of the ball striking face 16.

When a golf ball is struck by the golf club head 10, the forces generated are transferred rearwardly in a direction opposite the direction in which the golf ball travels in accordance with well known principles of physics. These forces pass through the ball striking face 16 and are absorbed by the arcuate member 30. The absorbed forces cause a slight deflection of the resilient arcuate member 30, which transfers to the force absorbing weight 26. The transferred forces are then evenly dissipated within the force absorbing weight 26.

The transfer of forces in this way results in an even distribution of the vibrational energy, and other forces, during the execution of a golf shot. This creates a better feel and increased energy transfer to the golf ball.

Figure 4:
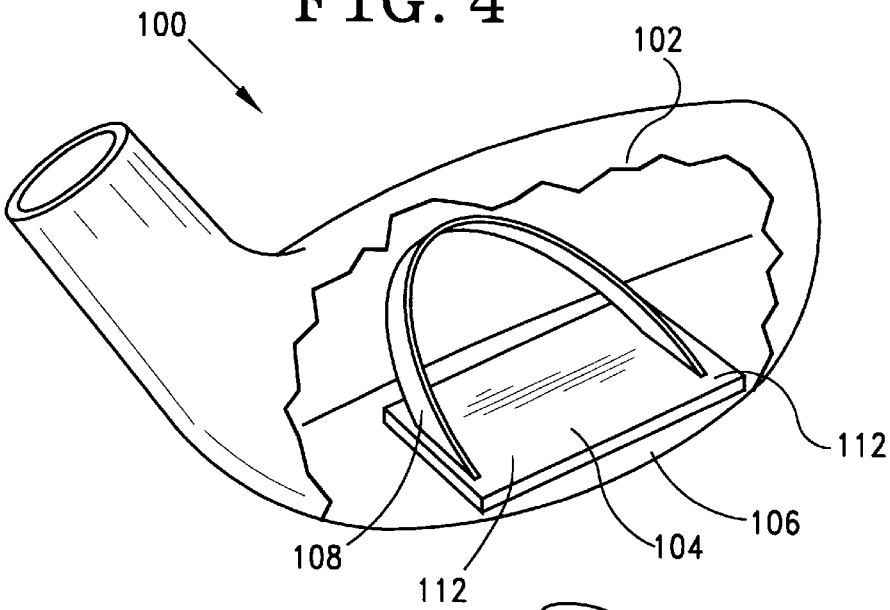
FIG. 4 is a partial cross sectional view of a second embodiment of a golf club head in accordance with the present invention.
Figure 5:
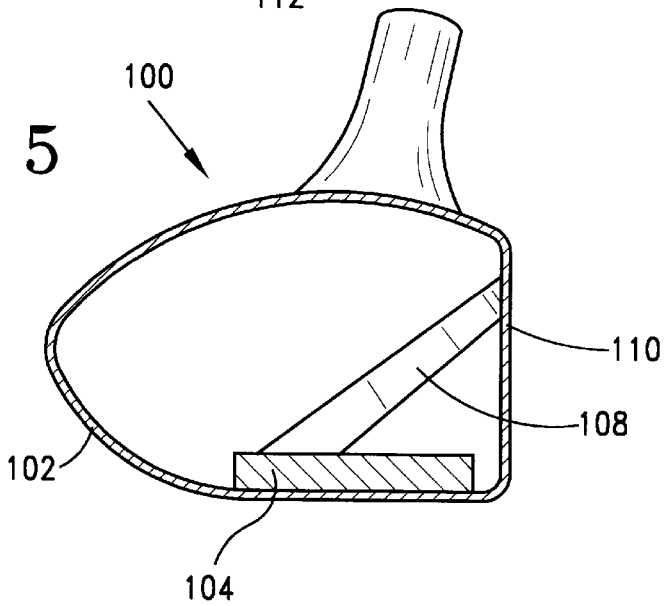
FIG. 5 is a cross sectional view taken along the line 5—5 in FIG. 4.

FIGS. 4 and 5 disclose the application of the present force absorbing system in a wood type golf club head 100. In accordance with the disclosed embodiment, the golf club head 100 is a metal wood type head including a shell 102 having a hollow interior. A force absorbing weight 104 is positioned on the bottom inner wall 106 of the shell 102. A resilient, arcuate member 108 is connected to, or touches, the inner wall 106 behind the ball striking face 110. The ends of the arcuate member 108 are connected to opposite ends 112 of the force absorbing weight 104.

Figure 6:
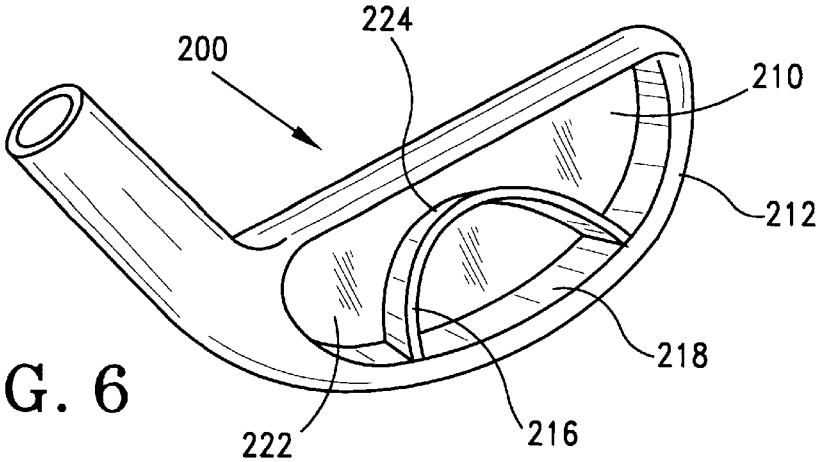
FIG. 6 is a rear perspective view of a third embodiment of a golf club head in accordance with the present invention.

FIG. 6 discloses an iron type golf club head 200 having a rear cavity 210 formed by a peripheral weight 212. A force absorbing arcuate member 216 is mounted on a shelf 218 formed by the upper surface of the peripheral weight 212. The arcuate member 216 is spaced from the cavity wall 222 except at the apex 224 where it engages the cavity wall 222 for force absorbing purposes as described above with respect to the embodiment disclosed in FIGS. 1 to 3.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A golf club head including a heel, toe, ball striking face, bottom, and rear surface opposite said ball striking face, wherein the improvement comprises:

a force absorbing mass distinct and removed from said rear surface, wherein the golf club head is formed of a first material and the force absorbing mass is formed of a second material which is denser than the first material; and a resilient force transmitting member connected between said force absorbing mass and said rear surface of said club head such that forces generated at said ball striking face of said club head cause slight deflection of said force transmitting member which is transmitted via said force transmitting member to said force absorbing mass; said force transmitting member being an arch shaped arcuate member having an apex in contact with said rear surface and legs extending away from said rear surface with ends of said legs attached to said force absorbing mass so as to evenly distribute forces generated at said ball striking face.

2. The golf club head of claim 1 wherein said apex of said arcuate member is integrally formed with said rear surface.

3. The golf club head of claim 1 wherein said force absorbing mass is located on an upper surface of said bottom of said club head.

4. The golf club head of claim 1 wherein said club head is a putter type club head, and said force absorbing mass and said force transmitting member are located within a rear cavity behind said rear surface of said club head.

5. The golf club head of claim 4 wherein said force absorbing mass is located on an upper surface of a rear flange of said club head.

* * * * *